United States Patent [19]

Birdwell

[11] Patent Number: 4,676,724

[45] Date of Patent: Jun. 30, 1987

[54] MUD PUMP

[76] Inventor: J. C. Birdwell, 8535 Glencrest, Houston, Tex. 77061

[21] Appl. No.: 692,319

[22] Filed: Jan. 16, 1985

Related U.S. Application Data

[60] Continuation of Ser. No. 581,230, Feb. 24, 1984, abandoned, which is a continuation of Ser. No. 348,497, Feb. 11, 1982, abandoned, which is a division of Ser. No. 133,948, Mar. 25, 1980, abandoned, which is a continuation of Ser. No. 220,527, Dec. 29, 1980, abandoned, and Ser. No. 309,979, Oct. 8, 1981, abandoned.

[51] Int. Cl.[4] ..... F04B 23/06; F04B 9/10

[52] U.S. Cl. ..... 417/342; 417/347; 417/552

[58] Field of Search ..... 417/342, 347, 390; 91/39

[56] References Cited

U.S. PATENT DOCUMENTS

| | | | |
|---|---|---|---|
| Re. 26,820 | 3/1970 | Bennett | 417/347 X |
| 564,112 | 0/1896 | Riggs et al. . | |
| 1,851,801 | 3/1932 | Boone | 91/39 X |
| 2,186,968 | 1/1940 | Grau . | |
| 2,198,301 | 4/1940 | Campbell . | |
| 2,402,300 | 6/1946 | Shimer . | |
| 2,442,916 | 6/1948 | Buchanan . | |
| 2,807,215 | 9/1957 | Hawxhurst . | |
| 2,998,781 | 9/1961 | Triebel . | |
| 3,022,738 | 2/1962 | Krute | 417/347 |
| 3,098,449 | 7/1963 | Hill . | |
| 3,123,007 | 3/1964 | Orr | 417/390 X |
| 3,295,451 | 1/1967 | Smith | 417/347 X |
| 3,312,172 | 4/1967 | Harklau et al. . | |
| 3,327,641 | 6/1967 | Klosterman | 417/342 X |
| 3,367,272 | 2/1968 | Smith . | |
| 3,373,695 | 3/1968 | Yohpe . | |
| 3,455,501 | 7/1969 | Urben . | |
| 3,514,226 | 5/1970 | Wood . | |
| 3,558,242 | 1/1971 | Jenkyn-Thomas . | |
| 3,558,244 | 1/1971 | Uchiyama . | |
| 3,652,188 | 3/1972 | Uchiyama . | |
| 3,662,652 | 5/1972 | Cole . | |
| 3,733,965 | 5/1973 | Braun . | |
| 3,749,524 | 7/1973 | Jordan . | |
| 3,787,147 | 1/1974 | McClocklin et al. . | |
| 3,809,508 | 5/1974 | Uchiyama . | |
| 3,920,356 | 11/1975 | Bruggeman . | |
| 3,930,756 | 1/1976 | Bruggeman . | |
| 3,976,401 | 8/1976 | Mountain . | |
| 4,067,484 | 1/1978 | Standlick . | |
| 4,076,457 | 2/1978 | Skinner et al. . | |
| 4,173,433 | 11/1979 | Anderson . | |
| 4,350,080 | 9/1982 | Page, Jr. . | |

FOREIGN PATENT DOCUMENTS

| | | |
|---|---|---|
| 080218 | 1/1983 | European Pat. Off. . |
| 0080385 | 1/1983 | European Pat. Off. . |
| 0075618 | 6/1983 | European Pat. Off. . |
| 589947 | 12/1924 | France . |
| 2153478 | 5/1973 | France . |
| 19484 | of 1907 | United Kingdom . |
| 767325 | 1/1957 | United Kingdom . |
| 2137260 | 10/1984 | United Kingdom . |
| 576434 | 10/1977 | U.S.S.R. . |

*Primary Examiner*—Leonard E. Smith
*Attorney, Agent, or Firm*—Arnold, White & Durkee

[57] ABSTRACT

A multicylinder, improved mud pump is disclosed, the preferred embodiment incorporating a hydraulically powered piston in a cylinder which connects with a piston rod which, in turn, drives a second piston in a cylinder adapted to pump mud. The first piston is driven by fluid from a rotary distribution valve, with the distribution valve being driven independently from the movement of the piston; also, the piston can be driven on its return stroke by entrapped fluid routed from a second cylinder, or the piston can be driven on its return stroke by fluid routed from the valve. Additinally novel valving means is disclosed for the rotary distribution valve and novel hydraulic drive circuitry is disclosed, also novel mud pumping valve and piston arrangements are disclosed.

10 Claims, 18 Drawing Figures

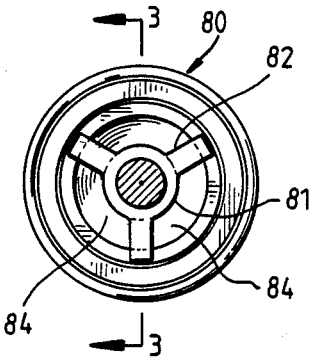
Fig. 2
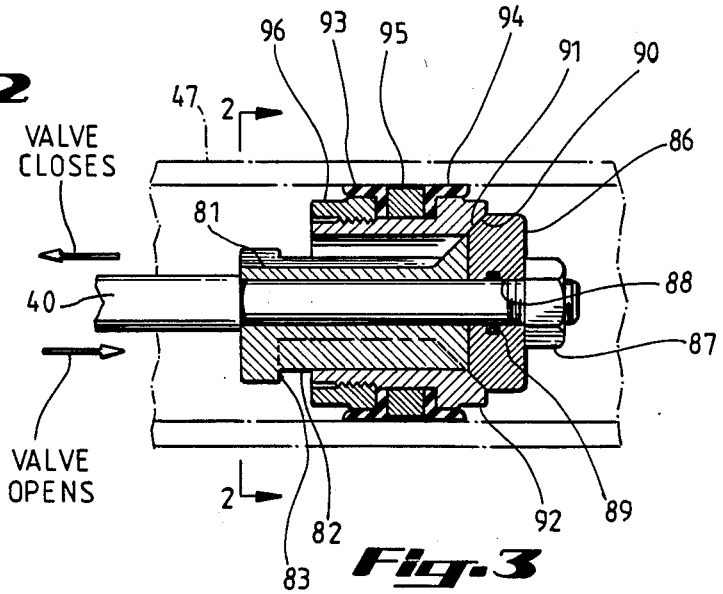
Fig. 3
Fig. 4
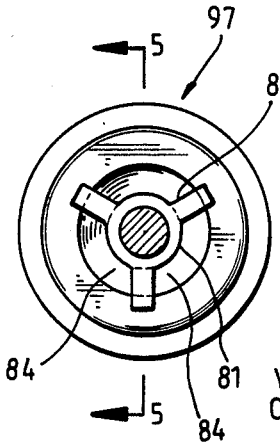
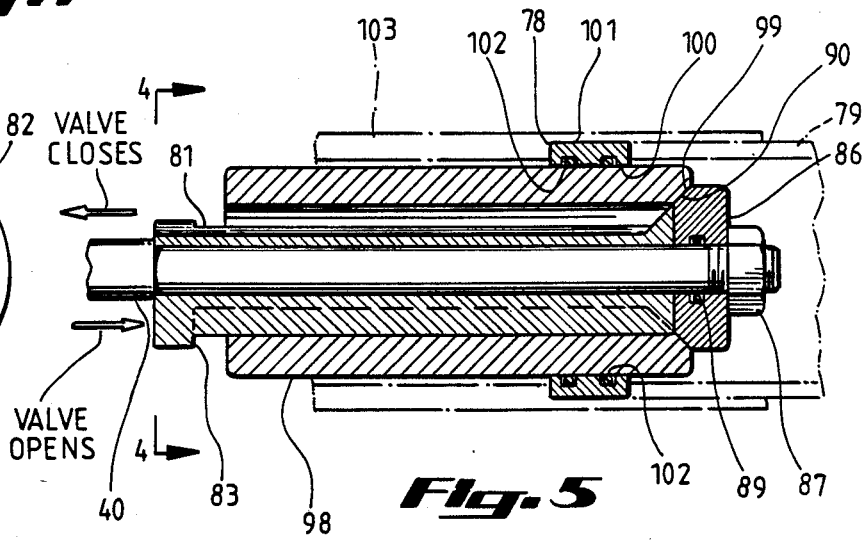
Fig. 5

MUD PUMP

REFERENCE TO OTHER APPLICATIONS

This application is a continuation of application Ser. No. 581,230, filed Feb. 24, 1984, now abandoned, which is a continuation of application No. 348,497, filed Feb. 11, 1982, now abandoned which is a divisional application of Ser. No. 133,948 filed Mar. 25, 1980, now abandoned; also a continuation in part of application Ser. No. 220,527, filed Dec. 29, 1980, now abandoned, and application Ser. No. 309,979, filed Oct. 8, 1981, now abandoned.

It is the object of the present application to provide an improved and more practical variation of patent application No. 220,527. Additionally to disclose novel and new means for utilizing the incoming mud pressure to assist in pressure intensification. Additionally to provide a simplified variation of the independently driven metering valve of patent application No. 220527.

BACKGROUND OF THE DISCLOSURE

The present apparatus is directed to a fluid mud pump and, more particularly, to a mud pump to be utilized to intensity fluid pressure for use in drilling oil wells or in conditioning oil wells such as fracturing with extremely high pressure or abrasive fluids. Various mud pumps and pressure intensification pumps are already known to exist that employ various and sundry means to overcome the difficulties encountered in prolonged pumping of high volume, high pressure, and abrasive materials. The present invention is an apparatus which will provide improvement in mud pumping operations in such areas as less output pressure pulsation, less operating energy required for fluid pressure intensification, slower operating piston speeds and longer piston strokes thus resulting in extended life of valves, pistons, liners, and other operating parts, wider range of fluid flow and pressure controlability, greater simplicity of manufacture, adaptability, and operation, plus other less apparent improvements. Thus the context of the problem to be dealt with in the present invention is that of a high power, constant pressure, efficient, rugged, and controllable fluid output pump.

BRIEF DESCRIPTION OF THE DRAWINGS

FIG. 2 is an end view of an alternate mud pumping piston that can be interchanged with the mud piston shown in FIG. 1.

FIG. 3 is a section view taken along the lines 3—3 of FIG. 2.

FIG. 4 is an end view of a second alternate mud pumping piston that can be interchanged with the mud piston shown in FIG. 1.

FIG. 5 is a section view taken along the lines 5—5 of FIG. 4.

DETAILED DESCRIPTION OF THE PREFERRED EMBODIMENT

Figure 1:
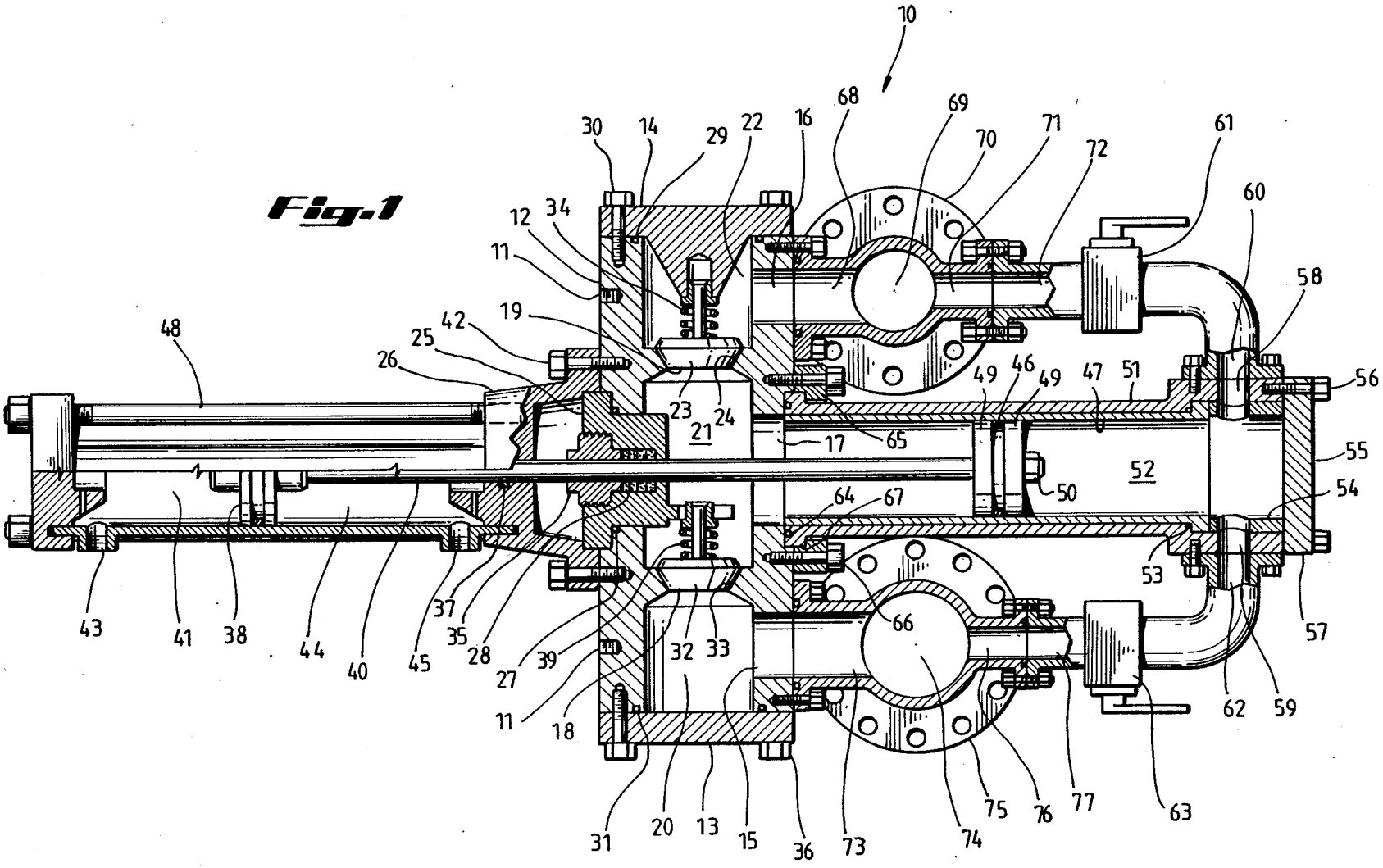
FIG. 1 is a section view of one pumping cylinder of a single cylinder mup pump system, or of a multicylinder mud pump system in accordance with the teachings of the present invention.

Attention is first directed to FIG. 1 of the drawings where the numeral 10 generally indentifies the mud pump of the present invention. In this illustrated embodiment a cross section of a pump consisting of a single pumping cylinder is shown. A more general arrangement will consist of a pump containing two or more, generally three, pumping cylinders each comprised of similar components. These two or more pumping sections being mounted side by side with each mud inlet port being connected to a common fluid supply annulus, and each pressure outlet ports being connected to a common discharge annulus, to form a multicylinder fluid mud pumping apparatus with a common fluid inlet supply annulus and a common fluid discharge annulus.

To this end, a main housing member 12 has threaded mounting holes 11 for attachment to a suitable support structure. Member 12 is a somewhat square elongated member with a central annulus therethrough of a generally circular form which is capped on one end by end cap 13 and on the other end by end cap 14. End cap 13 is in the form of a square plate and is attached to member 12 with bolts 36 and sealibly closes one end of the annulus by entrapment of seal 31. End cap 14 is a similar member but further contains a cone type extension that extends somewhat into the annulus of member 12. End cap 14 is attached to housing 12 by bolts 30 and entraps seal 29 to sealibly close the second end of the annulus. Member 12 contains circular side ports leading into the annulus at 15 to form a fluid inlet port, and at 16 to form a fluid outlet port, and at 17 to form a piston chamber port. Contained within the annulus of member 12 is a unidirectional inlet valve 18 and a unidirectional outlet valve 19 which are located to define fluid inlet chamber 20, compression chamber 21, and fluid outlet chamber 22. Inlet valve 18 has a finely structured circular face 32 which sealingly seats against a mating face 33 to seal against passage of fluid from compression chamber 21 to fluid inlet chamber 20. Outlet valve 19 also has a finely structured circular face 23 which sealingly seats against a mating face 24 to seal against the passage of fluid from outlet chamber 22 to compression chamber 21. Valve 19 is a poppet type unidirectional valve that is maintained in a spring loaded normally closed position by retainer spring 34. Likewise, valve 18 is a poppet type unidirectional valve that is maintained in a spring loaded normally closed position by retainer spring 39. Thus valve 18 will allow fluid flow from inlet chamber 20 to compression chamber 21 but will block flow in the reverse order, while valve 19 will allow flow from compression chamber 21 to outlet chamber 22 but will block flow in the reverse order.

Piston rod seal housing 25 is mounted in a circular bore that passes through the side of member 12 and opens into chamber 21 and whose centerline is in line with and concentric to the centerline of cylinder inlet port 17. Member 25 has a flange that has a circular circumference and a flat shoulder that is recessed into a counterbore of member 12 and which is retained in place by hydraulic cylinder end flange 26. The counterbore of member 12 contains a circumferential seal 27 which is held in place by the shoulder of member 25. Member 25 contains a circular bore through its center which is also in line with and concentric to inlet port 17. This center bore of member 25 contains a piston rod seal 28 that is retained in place by a threaded member 35. Member 35 also contains a circular bore through its center to allow passage therethrough of a piston rod 40 which further passes through seal 28 and is slideably sealed on its circumference by seal 28.

Member 26 is a specially adapted end flange of a hydraulic cylinder 48 and contains a piston rod seal 37 through which piston rod 49 passes. Member 26 attaches to member 12 by bolts 42 and centrally aligns hydraulic cylinder 48 with member 25. Hydraulic cylinder 48 is shown partially in section and partially in exterior view. The components of cylinder 48, with the exception of the modified end flange 26 and a specialized piston rod 40, are those components common to a standard hydraulic cylinder, and since this is a well known art it is not necessary to fully describe all the components of cylinder 48. To this end, hydraulic cylinder 48 contains piston 38 which is connected to and drivingly powers piston rod 40. Piston 38 is positioned to create a first fluid expansion chamber 41 which communicates with a fluid supply port 43, and also to create a second fluid expansion chamber 44 which communicates with a fluid supply port 45.

Hydraulic cylinder 48 will drivingly power piston rod 40 in one direction as pressurized fluid is admitted to port 43, while allowing fluid to be discharged from port 45. Correspondingly, piston rod 40 is powered in the opposite direction as pressurized fluid is admitted to port 45, while allowing flow to discharge from port 43. Thus piston rod 40 will continually reciprocate under power as pressurized fluid is continuously supplied alternately first to port 43, then to port 45, while correspondingly fluid is allowed to be continually discharged alternately first from port 45, then from port 43.

Piston rod 40 extends from hydraulic cylinder 48 through end flange 26, through rod seal housing 25, through compression chamber 21 and ends with connection to a mud pump piston 46 which is housed in a piston liner 47. Piston 46 is shown in exterior view. It contains circumferential seals 49 which form a slideable seal with piston liner 47 and which are rigidly and sealingly connected to piston rod 40 and retained in place by bolt 50 to effectively form a piston which will not allow fluid flow therethrough. Thus piston 46 sealingly separates the annulus of liner 47 into two distinct fluid expansion chambers, a first chamber defined as compression chamber 21 and terminating at a first face of piston 46, and a second chamber 52 terminating at a second end opposite face of piston 46.

Piston liner 47 is a round elongated member with a round bore therethrough and is centrally housed in the annulus of housing 51 and is retained in place by a flange type shoulder on one end, which seats against the shoulder of a recessed counterbore in housing 51. The liner shoulder entraps a circumferential seal 53 which forms a seal between liner 47 and housing 51. Pressing against the flange shoulder of liner 47 is a spacer 54 which holds the liner in place and which is itself retained in place by an end cap 55. End cap 55 attaches to housing 51 by bolts 56 and entraps a circumferential seal 57 that is positioned to form a seal between end cap 55 and housing 51.

End cap 55 is in the form of a square plate and attaches to a generally squared end on housing 51. Adjacent to the end cap, housing 51 contains rounded ports 58 and 59 which each pass through the walls of housing 51 and ultimately communicate with piston chamber 52. Spacer 54 also contains ports therethrough which are maintained in communication with ports 58 and 59 respectively by an alignment pin not shown. Sealingly connected to port 58 is a conduit 60 which further connects to one side of a shut-off valve 61. Likewise, part 59 is sealingly connected to a conduit 62 which further connects to one side of a second shut-off valve 63. Valves 61 and 63 are standard type valves with a full opening therethru and with a positive closing such as a globe valve. Thus piston 46, valve 61, and valve 63 combine to selectively define the prior established second fluid chamber 52 whose fluid connection therewith is selectively controllable by valves 61 and 63.

Piston liner housing 51 is a generally round elongated member with a circular flange 67 on one end for connection to member 12 and a somewhat raised square section on the other end for fluid ports and end cap connection. Housing 51 contains a round annulus therethrough for containment of piston liner 47 and spacer 54. Flange 67 contains a flat face with a seal 64 recessed therein and is adapted to mate with a recess in member 12 for circumferential sealing contact therewith. Also flange 67 is adapted to align the annulus of housing 51 with the centerline of bore 17, thus aligning piston liner 47 with the centerline of piston rod 40 and further providing an annulus connection between piston liner 47 and compression chamber 21. Flange 67 and thus housing 51 is rigidly supported in place by a split retainer ring 65 which in turn is secured to member 12 by bolts 66. Thus compression chamber 21 is established which will cause fluid to be drawn into and discharged therefrom as piston 46 reciprocates.

Fluid outlet port 16 sealingly connects to an outlet conduit 68 which is part of a discharge manifold with a discharge annulus 69. The discharge manifold has flanges 70 for sealingly connection to a discharge line or for connections to additional pumping sections and thence to a discharge line. The discharge manifold further contains a conduit 71 which sealingly connects to a conduit 72 that leads into the second side of shut-off valve 61 for controlled connection therethrough to conduit 60.

Fluid inlet port 15 sealingly connects to an inlet conduit 73 which is part of an intake manifold with an intake annulus 74. The intake manifold has flanges 75 for sealingly connection to an inlet supply line, or for connection to additional mud pumping sectins and thence to an inlet supply line. The intake manifold further contains a conduit 76 which sealingly connects to a conduit 77 that leads into the second side of shut-off valve 63 for controlled connection therethrough to conduit 62. Thus one face of piston 46 is exposed to fluid in compression chamber 21, while a second face is exposed to fluid in expansion chamber 52, fluid being selectively directed to chamber 52 from either the incoming supply fluid or from the outgoing pumped fluid as selected.

Attention is next directed to FIG. 2 and FIG. 3, which show an alternate mud pumping piston 80 that can be interchanged with and used in the place of mud piston 46 in order to create a different and advantageous pumping arrangement. Mud piston 80 is shown in an end view in FIG. 2, and FIG. 3 is a section view taken along the lines 3—3 of FIG. 2. In FIG. 2 & FIG. 3 piston 80 is shown attached to piston rod 40 with piston liner 47 illustrated by dashed lines. It will be understood that mud piston 80 can be attached to piston rod 40 and can be used to replace previously discussed mud piston 46, but that the functional operation of piston 80 is not the same as that of piston 46.

To this end, flow-thru guide member 81 is an elongated rounded member whose outside circumference consists primarily of three ribs 82 with smoothly finished exterior surfaces, each rib having a shoulder 83 at one end and merging into a circular section at the other end and at its intermost part. The circular section continues throughout the length of member 81 and combine with ribs 82 to form three flow passages 84 for fluid flow therethrough. Member 81 also has a central bore therethrough through which is inserted the reduced end of piston rod 40. Also inserted onto rod 40 and pressingly seated against one end of member 81 is a valve member 86 which is held in place by bolt 87 and which in turn holds member 81 in place by pressing member 81 against the shoulder created by the reduced end of rod 40. Member 86 contains a central bore 88, for insertion onto rod 40, that retains a seal 89 to seal the circumference of rod 40. Member 86 further contains a finely structured circular face 90 which sealingly seats against a mating finely structured circular face 91 that is formed on a seal member 92. Member 92 is a round elongated member with a central bore therethrough that is structured to slideably mate with the circumference of the ribbed sections 82 of member 81. Member 92 is inserted onto the ribbed sections of member 81 and is aligned to make contact with rib projections 83. Projection 83 limits the travel of member 92 in one direction and sealing face 90 limits the travel of member 92 in the other direction. Mounted onto member 92 are seals 93 and 94 which are of a cup type configeration and which are retained in place by a spacer ring 95 and a threaded retainer ring 96. Retainer ring 96 being threadingly connected to member 92 and positioned to clamp the inner flanges of seals 93 and 94 and spacer ring 95 to form a static seal therewith. Seals 93 and 94 form a slidable seal with piston liner 47.

As piston rod 40 moves in one direction to move sealing face 90 away from sealing face 91, fluid flow will be allowed to pass therethrough and to continue on through passages 84, thereby passing through piston 80. Correspondingly as piston rod 40 moves in a second direction to move sealing face 90 toward sealing face 91, then faces 90 and 91 will meet and form a fluid seal and will allow no flow to transverse across piston 80. Thus as piston rod 90 reciprocates fluid will be trapped and forced to move with the piston as the piston travels in one direction and conversely fluid will flow through the piston as the piston travels in the other direction. Note that piston 80 as described is reversible on piston rod 40 by removing the complete piston assembly, turning it end for end, and reinserting it on rod 40. This will reverse the flow-thru and sealing direction with respect to rod 40 travel direction. It will also be noted that a coil type spring could be installed between projection 83 and the end of member 92.

Attention is next directed to FIG. 4 and FIG. 5 where a plunger type piston valve 97 is shown that is operationally basically the same as prior described piston valve 80, but which has advantages over piston 80 in given applications which will be discussed later. FIG. 4 is an end view of piston 97 and FIG. 5 is a section view taken along the line 5—5 of FIG. 4. As can be clearly seen in FIG. 4 and FIG. 5, piston 97 is basically the same as piston 80 except for the sealing method relative to the piston liner. Consequently it is not necessary to repeat explanation of the same type members as already explained.

To this end, a plunger member 98 containing sealing face 99 is slideably inserted onto flow-through member 81. Member 98 is inserted through a bore 100 of a stationary seal housing 101, and makes slideable sealing contact with seals 102 that is contained in seal housing 101. Seal housing 101 is held in a stationary position by liner 103 which has an insert 79 that works in conjunction with liner 103 to lock seal housing 101 in place and to pressingly seal the end of seal housing 101 against a shoulder 78 of liner 103. Insert 79 and liner 103 are retained in place by prior described spacer 54. Thus when piston rod 40 moves in one direction fluid flow will be blocked from passing through plunger piston 97 because of sealing face 99 and 90. Correspondingly, when piston rod 40 moves in the opposite direction a gap will occur between sealing face 99 and sealing face 90 and flow will be allowed to pass through piston 97. Plunger member 98 is constructed to always operate within the confines of bore 100. Thus as with piston 80, when piston rod 40 reciprocates fluid will be trapped and forced to move with the plunger 98 as piston 97 travels in one direction and conversely fluid will be allowed to flow through piston 97 as piston rod 40 moves in the opposite direction. Piston 97 is also reversible on rod 40 the same as prior described for piston 80, and also could employ a coil spring the same as described for piston 80.

Figure 6:
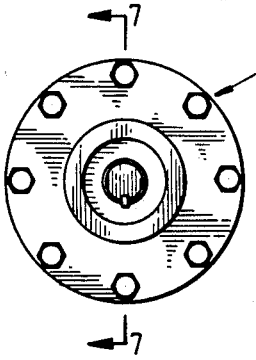
FIG. 6 is an end view of an independent driven metering valve that is used to distribute hydraulic fluid to the hydraulic drive cylinder of FIG. 1.
Figure 7:
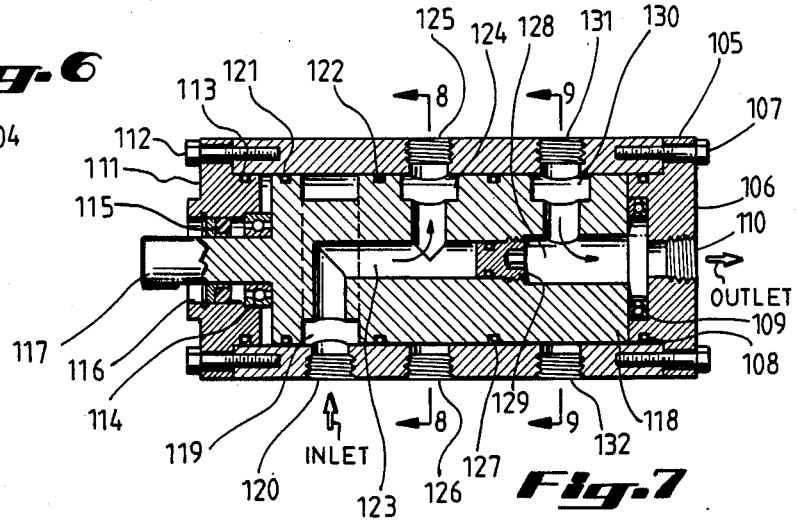
FIG. 7 is a section view taken along the line 7—7 of FIG. 6.
Figures 8, 9:
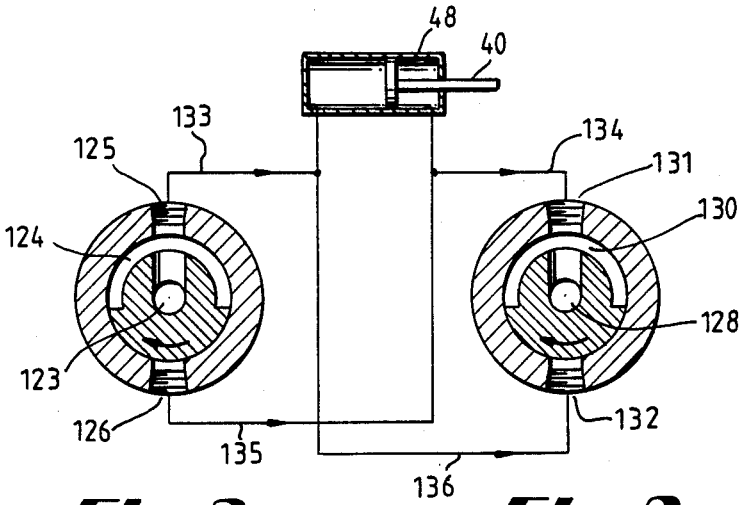
FIG. 8 is a section view taken along the lines 8—8 of FIG. 7.
FIG. 9 is a section view taken along the lines 9—9 of FIG. 7.

Attention is next directed to FIG. 6 which is an end view of a hydraulic metering valve 104. FIG. 7 is a section view taken along the lines 7—7 of FIG. 6, FIG. 8 is a section view taken along the lines 8—8 of FIG. 7, and FIG. 9 is a section taken view along the lines 9—9 of FIG. 7.

It will be noted that metering valve 104 is in fact a simplified arrangement of the independently driven fluid metering valve that was disclosed, along with the principle of using an independent driven fluid metering device to controllably meter fluid to perform and end use, in my patent application Ser. No. 959,524 filed Nov. 13, 1978. To this end, metering valve 104 contains a housing 105 which is a rounded member with a finely finished central bore therethrough. Housing 105 has an end plate 106 on one end which retains in place a seal 108 for sealing against flow therebetween. End plate 106 also contains a thrust bearing 109 which is lightly pressed into a recessed counterbore for containment, and a fluid return part 110 which passes therethrough and is threaded on the outer end for receipt of a hydraulic fluid return line. On the other end housing 105 has a second end plate 111 which is retained in position by bolts 112 and which retains in place a seal 113 for sealing against flow therebetween. End plate 111 also contains a central annulus therethrough into which is lightly pressed a second thrust bearing 114 and a seal 115, seal 115 being further retained by a snap ring 116.

Passing through the center of seal 115 and forming a rotatable fluid seal therewith is a drive shaft 117 whose end is fitted with a drive key for connection to a suitable rotary drive means. Drive shaft 117 is a reduced end section of a rounded, elongated, rotary valve member 118 which is rotably and sealingly enclosed within the annulus of housing 105 by bearings 109 and 114 and by seals 108, 113, and 115. Member 118 also contains a finely structured circumferential surface which is sealingly rotatable within the bore of housing 105. Contained with valve member 118 is a grove 119 that circles the circumference and continually communicates with a fluid inlet part 120 that is positioned in housing 105 to receive pressurized fluid. Bordering grove 119 are seals 121 and 122 which form a circumferential seal around member 118. Leading inward from grove 119 is an internal rounded port 123 within member 118 which leads to a second external grove 124 of a semicircular nature which is shown in communication with a fluid outlet port 125 in housing 105, port 125 being constructed to receive a fluid hydraulic line. Grove 124 is in communication with port 125 only as it is rotated past port 125. In the same plane as port 125 and positioned 180° from port 125 is a third port 126 located in housing 105 and which is also constructed to receive a fluid line connection, and which is positioned to communicate with chamber 124 as valve member 118 rotates and chamber 124 passes thereby. Seals 127 and 122 border semicircular grove 124 to form circumferential seals around member 118. Thus grove 124 will alternately distribute pressure fluid first to outlet port 125 and then second to outlet port 126 as member 118 rotates.

Member 118 further contains a central port 128 leading inward from, and in communication with, return port 110. A threadingly attached sealing plug 129 isolates internal port 128 from internal port 123. Port 128 leads to a second semicircular grove 130 that is formed in the outer circumference of member 118. Grove 130 is illustrated in communication with a fluid return port 131 that is in housing 105 and which is structured to receive a fluid hose connection. Grove 130 is in communication with port 131 only as the two pass during rotation of member 118. Located in the same plane as port 131 and at a 180° spacing from port 131 is a second fluid return port 132. Port 132 is positioned to be in communication with grove 130 as grove 130 rotatably passes thereby. Port 132 is also structured to receive a hydraulic hose connection. Thus as member 118 rotates within housing 105, return fluid flow is alternately distributed to return port 110, first from port 131 and second from port 132.

Referring to FIGS. 8 and 9 it can be clearly seen that as member 118 rotates and with hose connected as illustrated between hydraulic cylinder 48 and valve 104 and a pressurized fluid supply means connected to inlet port 120 and a fluid return means connected to port 110, then piston rod 40 in hydraulic cylinder 48 will be drivenly reciprocated. Briefly described, pressurized fluid supply at port 120 flows first to port 125, thence through fluid line 133 to one chamber of cylinder 48 while simultaneously return flow at port 128 communicates with return port 131 thence through fluid line 134 to the second chamber of cylinder 48. Port 132 and port 126 being sealed from flow by member 118. Thus piston rod 40 of cylinder 48 will be powered in one direction as grove 124 is rotated past port 125 while simultaneously grove 130 is rotated past port 131. Correspondingly, the piston of cylinder 48 will be driven in the opposite direction as valve member 118 contines to rotate and port 126 comes into communication with supply grove 124 and fluid thence flows through line 135 to cylinder 48 while simultaneously grove 130 rotates to become in contact with return port 132 to allow return flow from line 136 to communicate with return port 110, ports 125 and 131 being sealingly blocked by valve member 118. Thus piston rod 40 of cylinder 48 will be powerly reciprocated as valve 104 is rotated.

It will be noted that a second or third or more cylinders can be driven by metering valve 104 by adding additional cylinder fluid supply and return ports in member 104. When operating a single cylinder as illustrated in FIG. 8 and FIG. 9, grove 124 will preferably be of sufficient length to slightly overlap both ports 125 and 126 for a brief period so that supply fluid flow is not blocked as the cylinder piston changes direction, also correspondingly grove 130 will slightly overlap both ports 131 and 132 for a brief period. When operating two or more cylinders it will generally be desirable to have fluid supply grove 124 overlap and continually communicate with more than one outlet port to continuously and successively supply fluid to more than one piston chamber that is expanding, correspondingly to also have return metering grove 130 overlap and continually communicate with more than one return port to continuously and successively allow return flow of fluid from one or more piston chambers that are contracting. It will further be noted that by employing the use of a second grove 124, and having the first grove 124 operatively communicate with outlet port 125 only, while having the second grove 124 operatively communicate with a repositioned outlet port 126 only, and by doing the equivalency with the return grove 130 and return porting, and by selectively sizing of these groves 124 and 130, then flow volume passing through valve 124 can be separately metered to each piston chamber of cylinder 24 as required to cause the piston to stroke the same length in each direction. Thus the difference in area of the piston chambers, that is due to the piston rod, can be compensated for by the sizing of the groves 124 and 130. Also note that groves 124 and 130 can be structured to control the fluid flow therethrough as groves 124 and 130 comes into communication with, and discontinues communication from, the supply and return parts to effectively control the stopping and starting speed of the driven cylinders.

Figure 10:
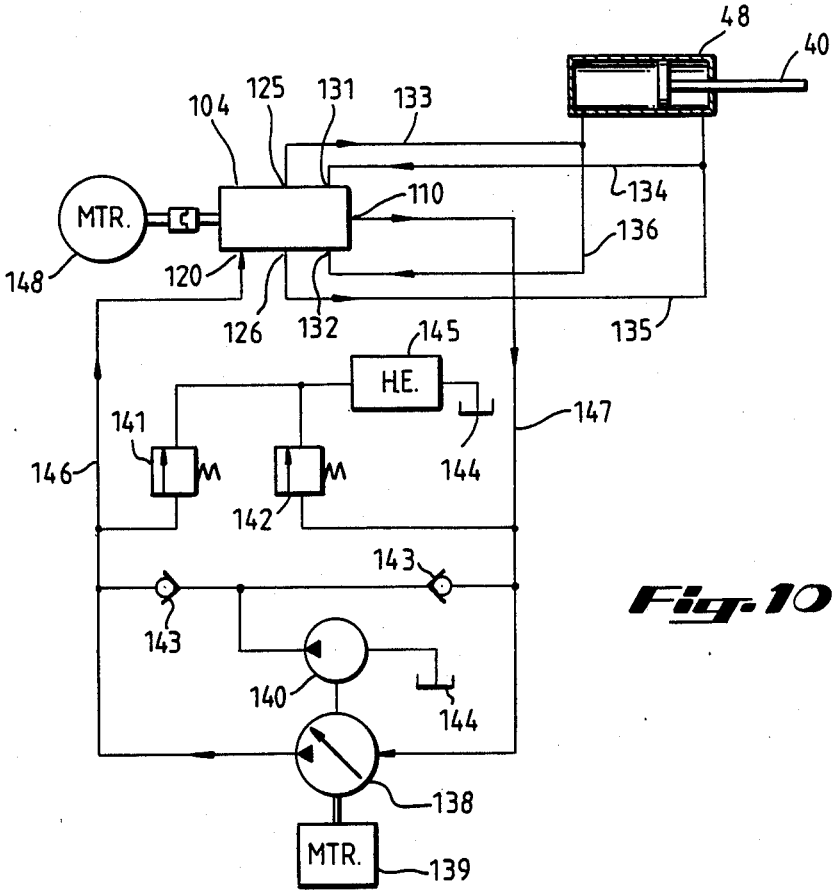
FIG. 10 is a schematic drawing showing the hydraulic drive system for the hydraulic cylinder of FIG. 1.

Attention is next directed to FIG. 10 which is a schematic drawing of a typical hydraulic circuit employed in conjunction with valve 104 to reciprocately drive hydraulic cylinder 48. The hydraulic pump shown is a variable volume pump with pressure compensated controls whereby the pump can be made to stroke-back or dwell in a no flow pressure holding condition if conditions warrant. The circuit illustrated is a closed loop charged hydraulic system. The main components of this circuit are a main pump 138 that is driven by a prime mover 139, a charge pump 140 that is likewise driven by prime mover 139, a high pressure relief valve 141, a low pressure relief valve 142, one way check valves 143, hydraulic reservoir 144, heat exchanger 145, main hydraulic fluid supply line 146, main hydraulic fluid return line 147, independent driven fluid metering valve 104 that is driven by motor 148, and hydraulic cylinder 48. The hydraulic circuit shown in FIG. 6 is well illustrated and the art of hydraulic circuitry is well known, so it is not necessary to completely describe the functions of each hydraulic component. Metering valve 104 has already been described.

Thus hydraulic pressurized fluid is supplied to metering valve 104 by hydraulic pump 138 through hydraulic line 146. Valve 104 continually meters the fluid as prior described to first one piston chamber of cylinder 48, then to the second piston chamber of cylinder 48, causing piston rod 40 to be continually reciprocated. It will be noted that metering valve 104 will preferably be driven at a speed that will allow the piston within cylinder 48 to reach its maximum allowable stroke length when hydraulic pump 138 is operated to supply its maximum volume. Thus as the hydraulic pump volume is descreased, the piston stroke length of cylinder 48 will correspondingly decrease. It will also be noted that the rotation speed of valve 104 can be controlled, independently from the cylinder piston stroke, to cause the valve rotation speed to vary at a rate corresponding to the variance rate of the fluid supply to maintain a continued full stroke piston opeation at various and different fluid flow rates.

It will be noted at this point that prior descriptions of metering valve 104 and corresponding hydraulic circuitry have dealt only with driving of hydraulic cylinder pistons in two directions by alternately switching the supply fluid from a first piston chamber to a second piston chamber to cause the piston to reciprocate. This is a desirable method of powering a reciprocating piston when power is required in each direction of piston travel, but is an undesirable method when the piston application requires power in only one direction of travel. In the disclosed pumping apparatus there are pumping arrangements which require power application in each direction of piston movement, but there are also pumping arrangements that require power applications primarily in one direction of travel only. To this end, attention is next directed to FIG. 11.

Figures 12, 13:
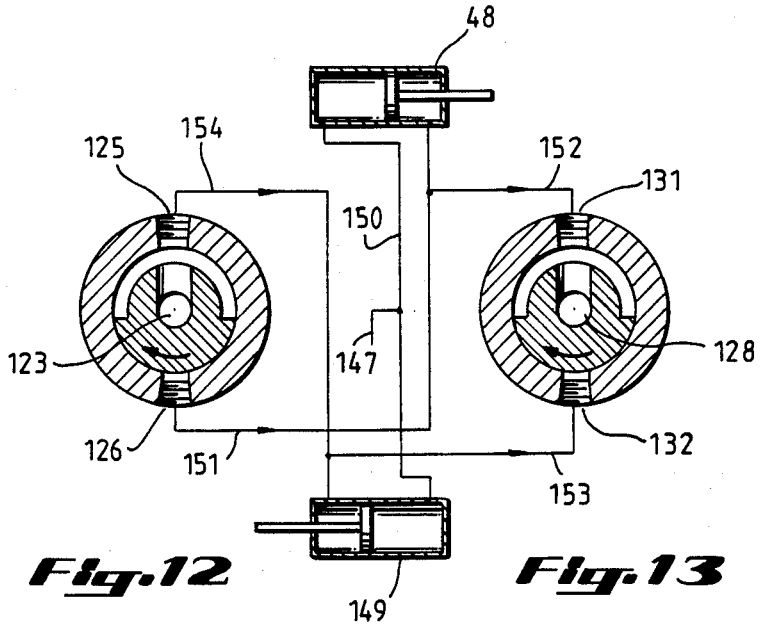
FIG. 12 is a section view taken along the lines 8—8 of FIG. 7, and is used to illustrate fluid flow lines of FIG. 11.
FIG. 13 is a section view taken along the lines 9—9 of FIG. 7, and is used to illustrate fluid flow lines of FIG. 11.
Figure 11:
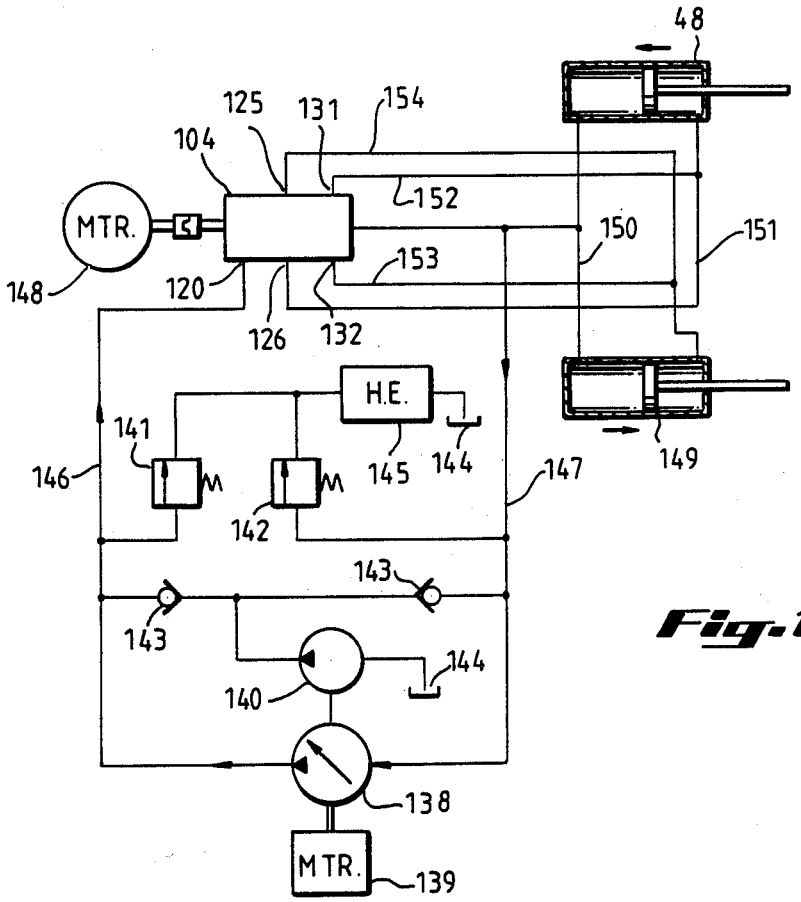
FIG. 11 is a schematic drawing showing a modification to the hydraulic system of FIG. 10 that can be employed when two or more pumping sections, as illustrated in FIG. 1, are being employed to form a multicylinder pump.

FIG. 11 is the same hydraulic system and components as shown, and described in FIGS. 6, 7, 8, 9, and 10, except FIG. 11 has two hydraulic cylinders in the circuit and the hydraulic lines from the metering valve to the hydraulic cylinders have been arranged to give a different fluid cylinder drive system from that shown in FIG. 10. Attention is also directed to FIG. 12 and FIG. 13, FIG. 12 being a section 8—8 taken along the lines 8—8 of FIG. 7, and FIG. 13 being a section 9—9 taken along the lines 9—9 of FIG. 7.

In FIG. 11 a first piston chamber of cylinder 48 is connected to a first piston chamber of a cylinder 149 by hydraulic line 150 which further connects to the hydraulic return line 147 of the hydraulic system. A second piston chamber of cylinder 48 is connected by hydraulic line 151 to outlet port 126 of metering valve 104 and by hydraulic line 152 to return port 131 of valve 104. A second piston chamber of cylinder 149 is connected by hydraulic line 154 to outlet port 125 of valve 104 and by line 153 to return port 132 of valve 104. Thus the first piston chamber of cylinder 48 and cylinder 149 are in communication and are part of an effective closed hydraulic reservoir with low pressure relief valve 142 controlling the pressure within the closed reservoir. Further, the first and second piston chamber of each cylinder 48 and cylinder 149 is in communcation within itself in an alternating and successive cycle as valve 104 rotates.

As pressurized fluid is supplied to inlet port 120 of metering valve 104 and valve 104 is rotated by motor 148, then pressure fluid will first be metered to the second piston chamber of cylinder 149 through valve outlet port 125 and thence through line 154 to cause the piston of cylinder 149 to move in one direction. Simultaneously the second piston chamber of cylinder 48 will be in communication with hydraulic system return line 147 through line 152 and return port 131. Thus because of the difference in piston area due to the piston rod, the piston of cylinder 48 will be driven in the opposite direction by the hydraulic system low pressure circuit fluid as the piston of cylinder 149 is powerly driven in one direction. Further, as valve 104 continues to rotate pressure fluid will next be metered to the second piston chamber of piston 48 through port 126 while simultaneously the second piston chamber of cylinder 149 will become in communication with hydraulic system return line 147 through return port 132 and thusly the piston of cylinder 149 will be driven in the opposite direction as the piston of cylinder 48 is powerly driven in one direction. Thus the pistons of hydraulic cylinders 48 and 149 will continually reciprocate with a powered stroke in one direction and a lower powered stroke in the other direction. The low pressure circuit fluid being continually supplied by pump 140.

Figure 14:
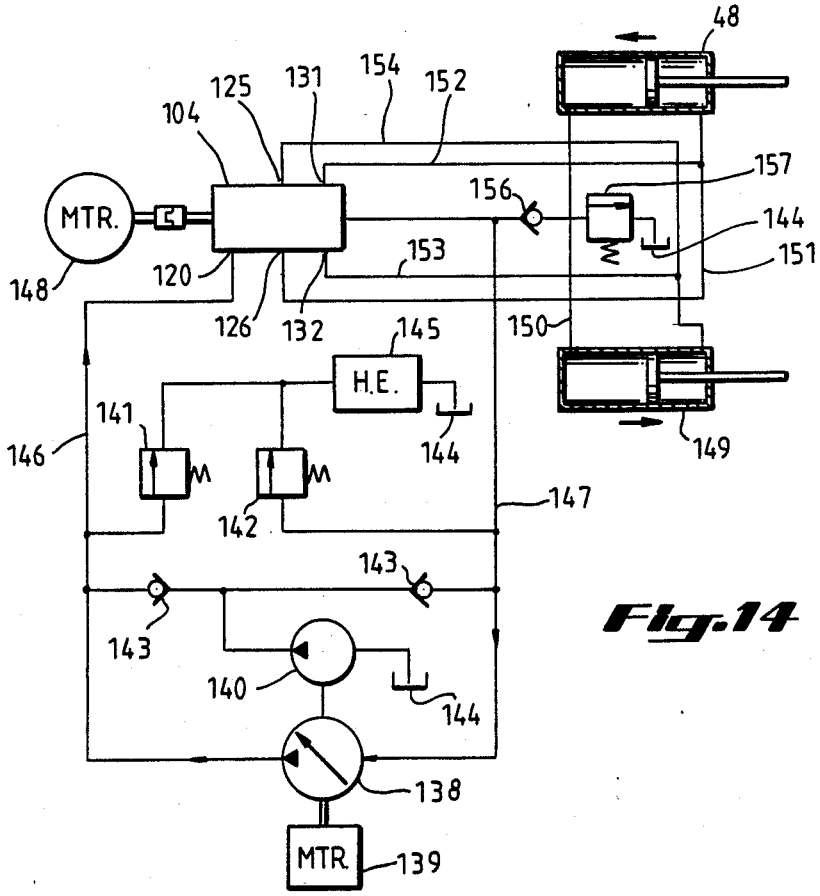
FIG. 14 is a schematic drawing showing a modification to the schematic system of FIG. 11 that can be adapted when two or more of the pumping sections illustrated in FIG. 1 are being employed in a multicylinder pump.

Attention is next directed to FIG. 14 which is the same hydraulic circuitry as shown in FIG. 11 and operates similar to that described for FIG. 11 except a one way check valve 156 has been added to the system to allow flow from hydraulic line 147 to line 150 but to prohibit flow from line 150 to line 147, and a pressure relief valve 157 has been added to line 150. With the hydraulic circuitry thusly affixed, the first piston chamber of hydraulic cylinder 48 and 149 will be interconnected into a closed hydraulic reservoir whose release pressure is controlled by relief valve 157 and consequently as the piston of one cylinder is powerly driven in one direction, the piston of the other cylinder will be reactively driven in the opposite direction. The significance of FIG. 14 being that the hydraulic circuit shown in FIG. 14 is a preferred hydraulic circuit for use with my patent pending application Ser. No. 959,524, Filed Nov. 13, 1978. Reference is made to this application for more detailed descriptions. Further, this hydraulic circuit clearly illustrates that metering valve 104 is in fact functionally the same valve as disclosed in my patent application Ser. No. 959,524. It will be noted that the hydraulic cylinder drive system shown in FIG. 11 and in FIG. 14 is adaptable to drive two or more hydraulic cylinders, while the hydraulic cylinder drive system shown in FIG. 10 is adaptable to drive one or more hydraulic cylinders.

Reference is again directed to FIG. 1 in which it will be observed that by adjusting valves 61 and 63 to given open or closed position, various different pumping situations can be arranged. FIGS. 15, 16, 17, and 18 illustrate four such different pumping arrangements. As we proceed through the discussions of FIGS. 15, 16, 17, and 18, it will be noted and clearly understood that whenever valve 61 or valve 63 is stated to be in a closed position, then this valve could be removed from the system and the connecting annulus therewith sealingly plugged and this would not deviate from the intent of this invention. Correspondingly, whenever valve 61 or 63 is stated to be in an open position, then this valve could be removed from the system and an open annulus provided therefor and this would not deviate from the intent of this invention. Furthermore, any time that either unidirectional inlet valve 18 or unidirectional outlet valve 19 is not a necessary part of the pumping system, then this valve could be removed and replaced therewith a solid sealingly member and this would not deviate from the intent of this invention. To this end, attention is directed to FIG. 15 in which a mud pumping system is illustrated with valve 61 being in a closed position and valve 63 being in an open position.

Figure 15:
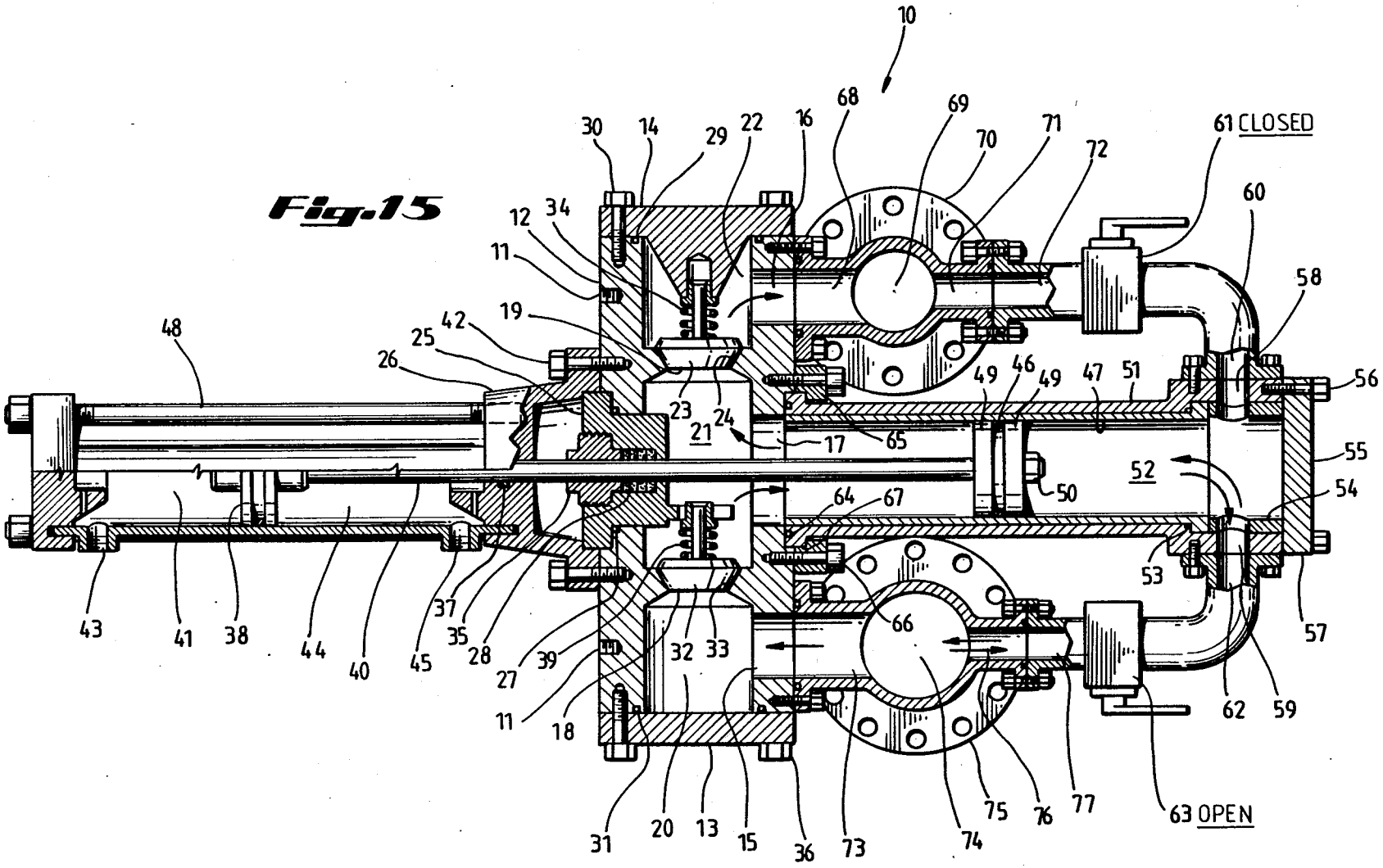
FIG. 15 is a view of FIG. 1 illustrating a first mud pumping system of the pump illustrated in FIG. 1.

In FIG. 15 supply fluid comes into inlet supply conduit 74, on to inlet valve 18 and also to chamber 52 on the second side of piston 46. Hydraulic cylinder 48 is supplied hydraulic fluid by metering valve 104 to cause the hydraulic piston and thus piston rod 40 to be reciprocately powered. Piston Rod 40 thus reciprocately strokes mud piston 46 and mud is drawn into compression chamber 21 across inlet valve 18 as mud piston 46 moves to expand compression chamber 21. Correspondingly, fluid mud is pumped across outlet valve 19 to outlet conduit 69 as mud piston 46 moves to compress compression chamber 21, thus fluid mud is caused to be pumped.

The significance of directing the incoming mud to the second or back side of mud piston 46 is that any pressure that is contained in the incoming fluid will be applied to the second side of the mud piston to assist in the compression stroke. As an example, if incoming mud is at a pressure of 5,000 P.S.I. and the pumped discharge pressure is 10,000 P.S.I., then piston rod 40 will experience only a force necessary to raise the pressure an additional 5,000 P.S.I. Whereby if the incoming fluid were not exposed to the second side of the mud piston, then piston rod 40 will experience the full force of acting against 10,000 P.S.I., the area of the piston rod being neglected for simplicity. Thus the fluid pump as illustrated in FIG. 15 will function as a true pressure intensifier and will utilize any incoming supply pressure so that the hydraulic drive cylinder will have to transmit only the force that is necessary to raise the mud fluid to a higher pressure.

Figure 16:
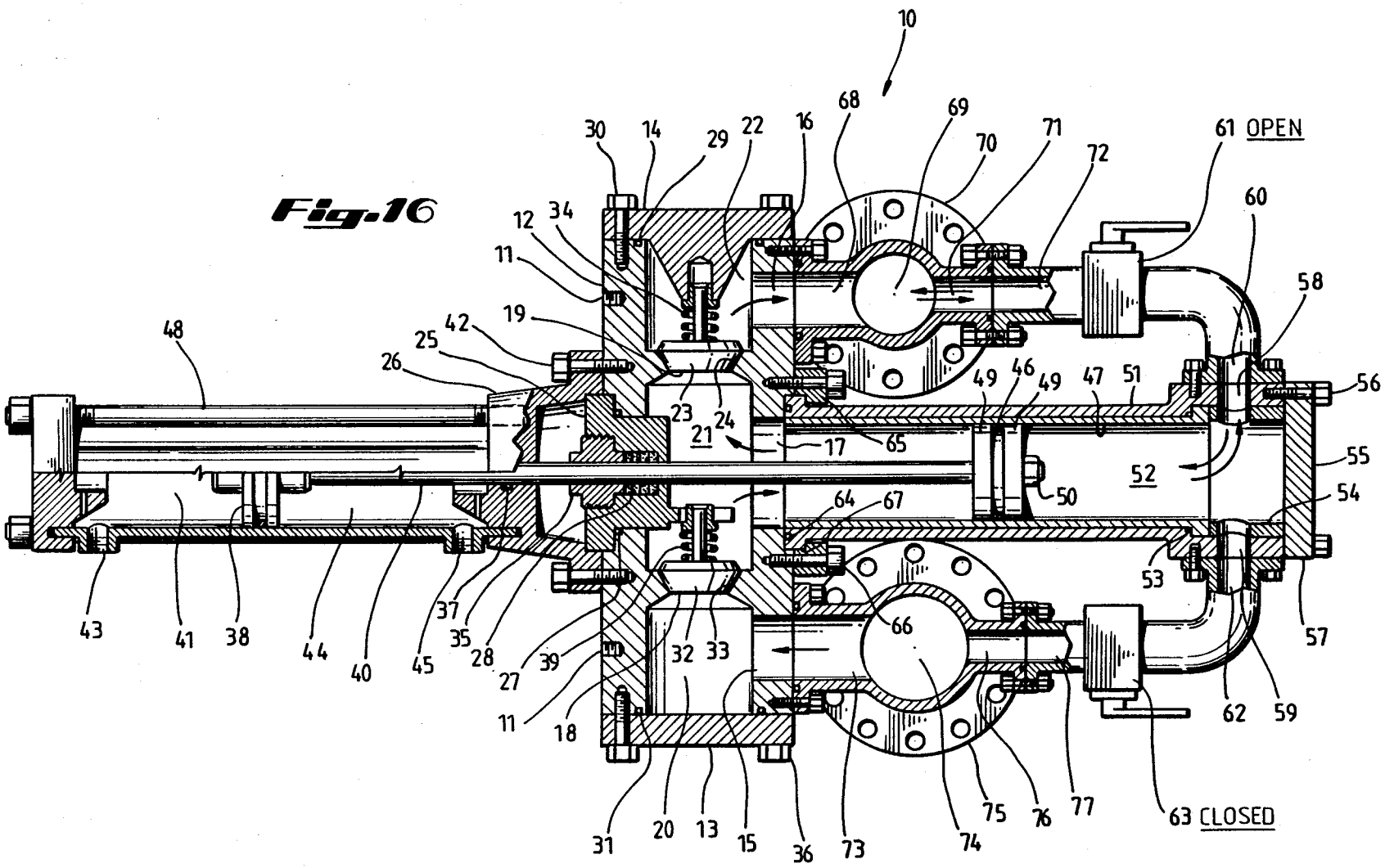
FIG. 16 is a view of FIG. 1 illustrating a second mud pumping system of the pump illustrated in FIG. 1.

Attention is next directed to FIG. 16 in which a mud pumping system is illustrated with valve 61 in an open position and valve 63 in a closed position. Piston rod 40 is reciprocately powered by hydraulic cylinder 48 as previously described. As mud piston 46 moves in a direction to expand compression chamber 21, inlet mud is drawn across inlet valve 18 and into chamber 21 from which it is transferred under pressure across outlet valve 19 to oulet conduit 69. With valve 61 in the open position, outlet pressurized fluid mud is in communication with the second side of mud piston 46, through valve 61 and piston chamber 52. Thus as mud piston 46 moves in a direction to expand expression chamber 21, it will in actuality be discharging or compressing mud that is in the outlet conduit 69 without the distinction of dicharging through the unidirectional valve. Also the incoming mud will be on the compression chamber 21 side of the piston so that any pressure that is contained within the incoming mud will be utilized to assist the piston rod in moving the mud piston. Conversely, as the mud piston moves in a direction to compress chamber 21, the fluid mud pressure will be relatively equalized on each side of the mud piston at a pressure equal to the outlet conduit pressure and thus mud fluid will be transferred across outlet valve 19 thusly with little or no back pressure. Two major improvements derived from this pumping system are the utilization of any pressure that is in the supply or incoming mud, and the elimination of pressure peaks that would normally be required to open unidirectional outlet valve 19. In the discussion of this pumping system, the piston area difference due to piston rod 40 has not been taken into consideration for simplification reasons.

Figure 17:
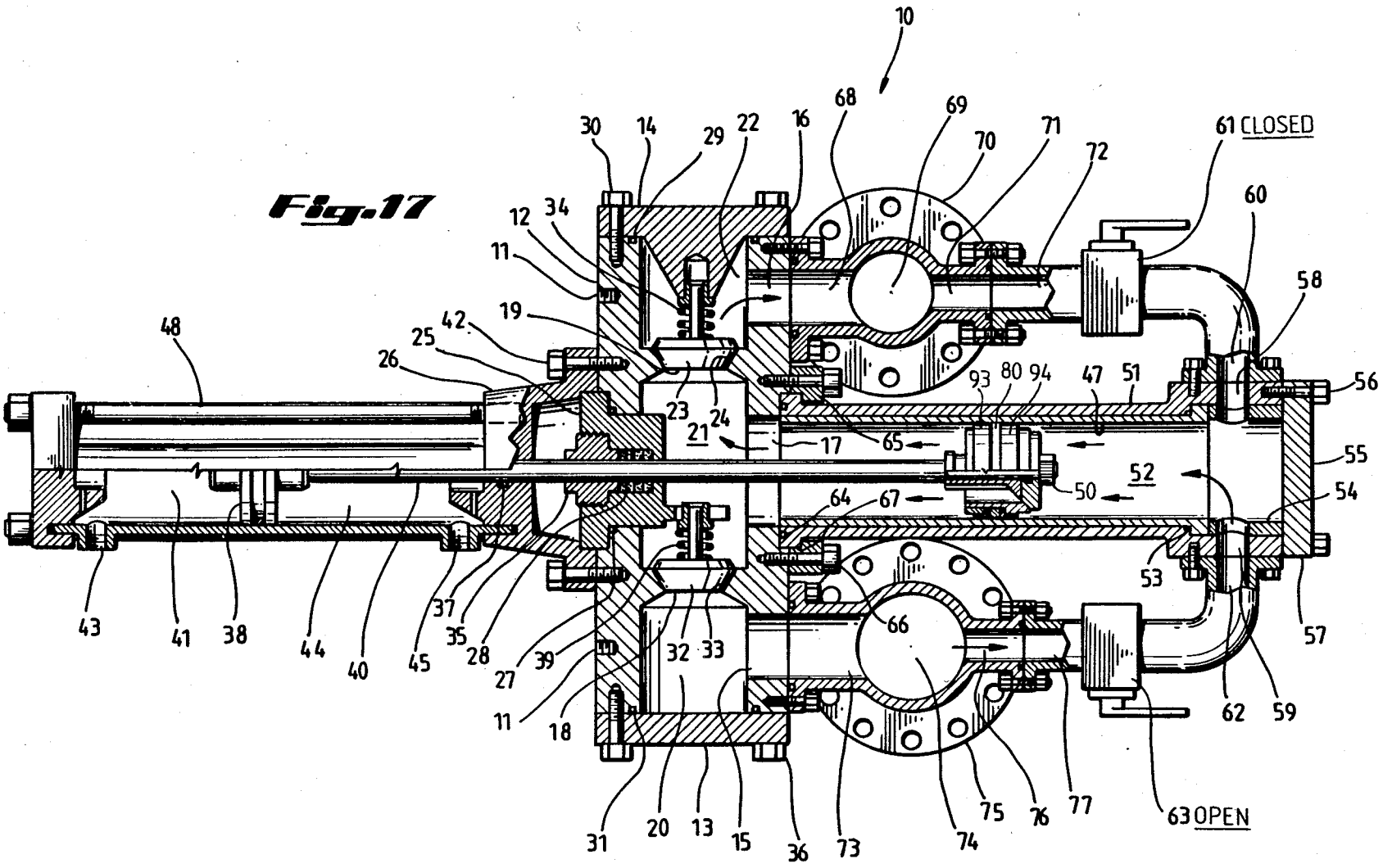
FIG. 17 is a view of FIG. 1 illustrating a third mud pumping system of the pump illustrated in FIG. 1.

Attention is next directed to FIG. 17 which is a third pumping system that can be employed with mud pump 10. In this illustration a mud piston containing an internal unidirectional valve, which could be either piston assembly 80 or piston assembly 97, is used with the piston assembly oriented to rod 40 so that the internal valve seals against flow as piston rod 40 moves in a direction to cause the mud piston to decrease chamber 21. For the following description we will select piston assembly 80. To this end, valve 61 is positioned in a closed condition and valve 63 is positioned in an opened condition. Inlet supply fluid is in communication with second mud piston chamber 52 through open valve 63 and will flow into chamber 21 through piston 80 as piston rod 40 moves to open the internal piston valve and further to increase the volume of compression chamber 21. Then as piston rod 40 moves to close the internal piston valve and further to decrease the volume of compression chamber 21, fluid will be pumped across outlet valve 19 to outlet conduit 69. The internal valve assembly of piston 80 has positive opening and closing characteristics controllable by piston rod 40 movement which will provide positive opening and closing of this valve that will result in extended valve life and better fluid flow through the pumping system. Also note that in this pumping system inlet valve 18 could serve as a second fluid inlet valve to give a greater flow capability into chamber 21. Also note that valve 18 could be removed and replaced with a solid sealing member if desired.

Figure 18:
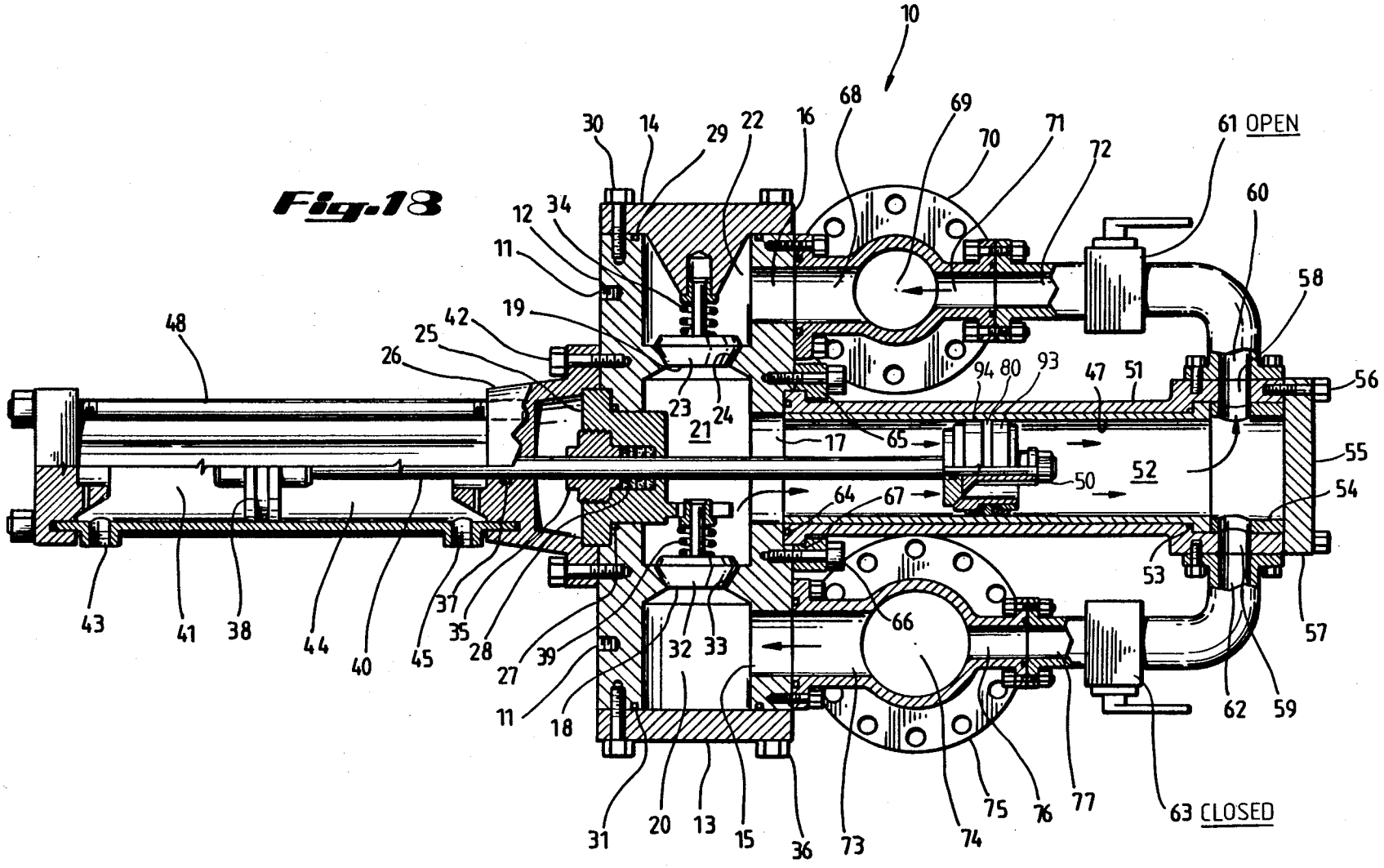
FIG. 18 is a view of FIG. 1 illustrating a fourth mud pumping system of the pump illustrated in FIG. 1.

Attention is next directed to FIG. 18 which is a fourth pumping arrangement that can be employed with mud pump 10. In this illustration a mud piston containing an internal unidirectional valve, which could be piston assembly 80 or piston assembly 97, is used with the piston assembly oriented to rod 40 so that the internal valve seals against flow as piston rod 40 moves in a direction to expand chamber 21. To this end, valve 61 is positioned in an open position and valve 63 is positioned in a closed position. For the following description we will select piston assembly 80. As piston rod 40 moves in a direction to expand chamber 21, the internal valve will close to flow therethrough and fluid will be discharged from chamber 52 to outlet annulus 69, correspondingly inlet fluid will be drawn across inlet valve 18 to fill chamber 21. Correspondingly as piston rod 40 moves in a direction to decrease chamber 21, then the internal valve in piston 80 will open and allow flow to pass through piston 80 into chamber 52. Thus pressurized fluid will be transferred across piston 80 without any pressure peak required to open the valve and with no pressure differential. Consequently the valve life will be extended and the pressure fluctuations will be minimized. Outlet valve 19 really serves no purpose in this arrangement and could be removed and the opening sealed if desired.

It will be noted that piston assembly 97, which is a plunger type piston, is generally a preferred piston to use when operating with extreme high pressures, this being due primarily to closer tolerances that can be employed with a stationary type seal. It will further be noted that in FIG. 1 hydraulic cylinder 48 could be located to operate from either end of housing member 51 to place the piston rod loading in tension or compression as desired. In other words, Piston 48 can be located where end plate 55 is now shown and end plate 55 can be located where cylinder 48 is now shown.

The foregoing is directed to the preferred embodiment, but the scope of the present invention is determined by the claims which follow.

I claim:

1. A linear output, hydrostatic, hydraulic transmission, comprising:

fluid driven, drive piston means, each said means having a first side and a second side, each said drive piston means being housed in a separate drive cylinder means, wherein each said drive piston means may receive a continuous flow of pressurized drive fluid to displace said drive piston means within said drive cylinder means;

a rotary driven, pressure intensification source to supply the said continuous flow of pressurized drive fluid, said source having a pressurized fluid outlet and a lower pressure fluid inlet;

said drive piston means transmitting an output drive motion characterized in that during operation, at least one of said drive piston means will be displaced in a first drive direction within said cylinder means at all times, while said drive piston means will be periodically displaced in a second return direction within each said cylinder means;

control valve means for connecting, independent of drive piston position or movement, but in a timed sequence, said fluid pressure intensification source at its outlet in stepwise turn to each said drive cylinder means, and for connecting other of said drive cylinder means to said fluid pressure intensification source at its said inlet to thereby continually drive one or more drive piston means in said first drive direction, in sequential turn and in an overlapping manner;

an expansionary fluid circuit entrapping a second pressured fluid within said drive cylinder means on a first side of said drive piston means; whereby movement of one or more of said drive piston means in said first direction in turn displaces other of said drive piston means in said second return direction;

means to continually add said second pressured fluid to said expansionary fluid circuit for causing an expansion thereof, and means to exhaust excess fluid from said expansionary fluid circuit automatically upon a given rise in pressure therewithin;

a closed hydraulic fluid loop connecting said drive cylinder means proximate said second side of said drive piston means, said control valve means, and said fluid pressure intensification source, and wherein said fluid pressure intensification source supplies pressurized drive fluid directly to one or more of said drive cylinder means and whereby lower-pressure spent drive fluid is returned directly to said inlet of said fluid pressure intensification source from one or more of said drive cylinder means;

means to add and remove pressurized drive fluid to said closed hydraulic fluid loop;

means to circulate said pressurized drive fluid through said closed hydraulic fluid loop to cool said pressurized drive fluid; and wherein said expansionary fluid circuit is fluidly connected with said lower pressure portion of said closed hydraulic fluid loop.

2. A linear output, hydrostatic, hydraulic transmission, comprising:

fluid driven, drive piston means, each said means having a first side and a second side, each said drive piston means being housed in a separate drive cylinder means, wherein each said drive piston means may receive a continuous flow of pressurized drive fluid to displace said drive piston means within said drive cylinder means;

a rotary driven, pressure intensification source to supply the said continuous flow of pressurized drive fluid, said source having a pressurized fluid outlet and a lower pressure fluid inlet;

said drive piston means transmitting an output drive motion characterized in that during operation, at least one of said drive piston means will be displaced in a first drive direction within a said cylinder means at all times while said drive piston means will be periodically displaced in a second return direction within each said cylinder means;

control valve means for connecting, independent of drive piston position or movement, but the timed sequence, said fluid pressure intensification source at its outlet in stepwise turn to each said drive cylinder means, and for connecting other of said drive cylinder means to said fluid pressure intensification source at its said inlet to thereby continually drive one or more drive piston means in said first drive direction, in sequential turn and in an overlapping manner;

an expansionary fluid circuit entrapping a second pressured fluid within said drive cylinder means on a first side of said drive piston means; whereby movement of one or more of said drive piston means in said first direction in turn displaces other of said drive piston means in said second return direction;

means to continually add said second pressured fluid to said expansionary fluid circuit for causing an expansion thereof, and means to exhaust excess fluid from said expansionary fluid circuit automatically upon a given rise in pressure therewithin;

a closed hydraulic fluid loop connecting said drive cylinder means proximate said second side of said drive piston means, said control valve means, and said fluid pressure intensification source, and wherein said fluid pressure intensification source supplies pressurized drive fluid directly to one or more of said drive cylinder means and whereby lower-pressure spent drive fluid is returned directly to said inlet of said fluid pressure intensification source from one or more of said drive cylinder means;

means to add and remove pressurized drive fluid to said closed hydraulic fluid loop;

means to circulate said pressurized drive fluid through said closed hydraulic fluid loop to cool said pressurized drive fluid; and wherein said expansionary fluid circuit is continually supplied fluid by said closed hydraulic fluid loop.

3. A reciprocating hydraulic motor, adapted for use in driving a reciprocating hydraulic pump, comprising:

a plurality of cylinders each having a first end and a second end;

a separate pistons positioned within each said cylinder, each said piston being capable of reciprocal displacement within its respective cylinder, each said piston defining a first compartment and a second compartment within its respective cylinder;

a first pressurized fluid source having a pressurized fluid inlet and a pressurized fluid outlet;

a control valve to control the flow of said first pressurized fluid from said outlet of said fluid source to each said first compartment of each said cylinder, said control valve being operated independently of piston position and movement, said control valve also controlling the flow of said first fluid from each said first compartment to said fluid inlet of said fluid source as said first fluid is exhausted from said first compartments by said pistons displaced in said second return direction;

first conduits connecting each said first compartment to said control valve;

a second conduit connecting said control valve with said pressurized fluid outlet of said first pressurized fluid source;

a third conduit connecting said control valve with said pressurized fluid inlet of said first pressurized fluid source to transfer said exhausted first fluid to said fluid inlet;

fourth conduits connecting said pressurized fluid inlet with each said second compartment of each said cylinder, thereby creating an expansionary fluid circuit common to said fluid inlet and each said second compartment;

a second pressurized fluid contained within the said second compartments of each said cylinder thereby creating an expansionary fluid circuit, wherein each said piston is sequentially displaced in a second return direction by said second pressurized fluid entrapped within said expansionary fluid circuit, displacement of one or more of said pistons in said first direction thereby displacing said second pressurized fluid from respective second compartments through said fourth conduits into other of said second compartments thereby displacing other said pistons in said second return direction;

means to continually add and remove said second pressurized fluid in said expansionary fluid circuit so that the volume of said second pressurized fluid circuit varies when each piston is displaced in a cycle, said cycle being defined by one piston displaced in both a first and second direction;

wherein said second pressurized fluid is removed from said expansionary fluid circuit when at least one of said pistons is displaced in said first direction by said first pressurized fluid thereby increasing the pressure of said second pressurized fluid entrapped within said expansionary fluid circuit to a given pressure;

wherein said second pressurized fluid is added to said expansionary fluid circuit when said control valve allows said first pressurized fluid to exhaust from at least one of said first compartments of said cylinders; and wherein said additional second pressurized fluid in said expansionary fluid circuit causes momentary simultaneous restriction of movement of all said pistons displaced in said second return direction, thereby causing said increase in pressure of said second pressurized fluid.

4. The motor according to claim 3 including means to vary the volume of said first pressurized fluid supplied to said control valve to thereby vary the distance each said piston is displaced within its respective cylinder in said first direction.

5. The motor according to claim 3 including means to vary the operational speed of said control valve to vary the distance each said piston is displaced in said first direction and including means to add or remove said second pressurized fluid in said expansionary fluid circuit to compensate for said change in said second fluid volume caused by said variance in displacement distance.

6. The motor according to claim 3 wherein said expansionary fluid circuit is connected to said third conduit transferring said exhausted first fluid from said control valve.

7. The motor according to claim 3 wherein fluid is added to said expansionary fluid circuit by said first pressurized fluid source.

8. The motor according to claim 3 wherein each said piston is connected to a reciprocating positive displacement fluid pumping means, via a separate connecting rod having a first end and a second end, said first end of each said rod being connected to a separate said piston, said second end of said connecting rod being connected to said pumping means; and including means to drive said control valve independently of piston position and movement.

9. The motor according to claim 8 wherein said fluid pumping means includes unidirectional valves and reciprocating pump piston means whereby said pumping means displaces fluid and receives fluid as said pistons of said motor are displaced in said first direction to thereby create a substantially uninterrupted pumping action of fluid through said pumping means.

10. The motor according to claim 9 wherein said reciprocating pump piston means is slidably and sealingly encased within a pumping chamber by a replaceable liner.

* * * * *